US010107604B1

(12) United States Patent
Spaulding et al.

(10) Patent No.: US 10,107,604 B1
(45) Date of Patent: Oct. 23, 2018

(54) TRACER INSERT AND TRACER SHELL INCORPORATING SAME

(71) Applicant: D&S Comet Shotgun Tracersl LLC, Prescott Valley, AZ (US)

(72) Inventors: Houston Spaulding, Prescott Valley, AZ (US); Lester S Dixon, Prescott Valley, AZ (US)

(73) Assignee: D&S COMET SHOTGUN TRACERS LLC, Prescott Valley, AZ (US)

( * ) Notice: Subject to any disclaimer, the term of this patent is extended or adjusted under 35 U.S.C. 154(b) by 0 days.

(21) Appl. No.: 15/589,957

(22) Filed: May 8, 2017

(51) Int. Cl.
*F42B 12/38* (2006.01)
*F42B 7/02* (2006.01)
*F42B 7/08* (2006.01)

(52) U.S. Cl.
CPC ..... *F42B 12/38* (2013.01); *F42B 7/02* (2013.01); *F42B 7/08* (2013.01)

(58) Field of Classification Search
CPC .. F42B 12/38; F42B 12/46; F42B 7/02; F42B 7/08
See application file for complete search history.

(56) References Cited

U.S. PATENT DOCUMENTS 3,234,877 A * 2/1966 Herter
3,405,638 A * 10/1968 Stoner, Jr. ..... F42B 7/02 102/449
4,301,732 A * 11/1981 Van Sickle
4,841,866 A * 6/1989 Miesner ..... F42B 7/04 102/458
5,361,701 A * 11/1994 Stevens ..... C06B 33/00 102/450
5,429,054 A * 7/1995 Topping ..... F42B 7/08 102/451
7,610,857 B1 * 11/2009 Dunnam ..... F42B 12/382 102/458
7,836,828 B2 * 11/2010 Martikainen ..... F42B 7/04 102/458
8,001,903 B1 * 8/2011 Quintana ..... F42B 12/38 102/370
8,919,255 B1 * 12/2014 Quintana ..... F42B 12/38 102/449
2005/0056184 A1 * 3/2005 Dunnam ..... F42B 7/08 102/458

(Continued)

*Primary Examiner* — Benjamin P Lee
(74) *Attorney, Agent, or Firm* — Invention To Patent Services; Alex Hobson

(57) ABSTRACT

A tracer insert has an upper cavity for retaining shot and a lower cavity for retaining a tracer powder compound. The tracer insert is configured for placement within the shot-pocket of a wad within a shotgun shell. The shot is placed in and around the tracer insert within the shot pocket and some shot is retained within the upper cavity of the tracer insert. A bottom exhaust port in the lower cavity allows the release of the tracer powder compound upon firing of the tracer shell. A cavity separator separates the upper and lower cavities and a flow channel may extend down from the top of the tracer insert into the lower cavity to allow a flow of air to aid in the release of the tracer powder compound. Side exhaust ports may be configured around the lower cavity to provide additional release area for the tracer powder compound.

20 Claims, 6 Drawing Sheets

(56) References Cited

U.S. PATENT DOCUMENTS

| | | | | |
|---|---|---|---|---|
| 2005/0188882 | A1* | 9/2005 | Diller | F42B 7/04<br>102/458 |
| 2013/0042783 | A1* | 2/2013 | Diller | F42B 7/04<br>102/513 |
| 2014/0261043 | A1* | 9/2014 | Diller | F42B 33/02<br>102/458 |
| 2015/0354931 | A1* | 12/2015 | Diller | F42B 12/38<br>102/458 |

* cited by examiner

TRACER INSERT AND TRACER SHELL INCORPORATING SAME

BACKGROUND OF THE INVENTION

Field of the Invention

The invention relates to tracer inserts and tracer shells incorporating said tracer inserts.

Background

Shooting sports require accuracy and learning how to accurately aim can be difficult, especially when firing at moving targets. For example, when firing at a skeet, a shooter may miss the moving target but not know if they were aiming too high, ahead of the flying skeet or behind it. Tracer rounds can dramatically help shooters improve their accuracy. A tracer round will show that the shooter has a tendency to fire behind the moving target, or above the moving target, for example, and then the shooter can make the required adjustments. Unfortunately, commercially available tracer rounds for shotgun shells have a very short tracer visibility distance, thereby making it difficult for a shooter to learn from the tracer trail as it ends well short of the target. In addition, commercially available tracer rounds are not provided in a form for reloaders, shooters who reload their own shells; rather the tracer shells are provided for one-time use. Therefor a need exists for a tracer shell that has a long tracer trail and is provided in a form for reloading.

SUMMARY OF THE INVENTION

An exemplary tracer insert is configured for placement in a shot-pocket of a wad that is placed into a shotgun shell. The tracer insert has an upper cavity that retains shot that propels the tracer insert upon firing. The upper cavity may have an opening that tapers to allow shot to be trapped within the upper cavity. The tracer insert has a lower cavity for retaining a tracer powder compound. The compound is solid but upon agitation breaks up into powder that is released through a bottom exhaust port to provide a tracer trail upon firing An exemplary tracer insert comprises a tracer insert body that may be a single piece unit. For example, the tracer insert body may be made from plastic, such as by injection molding. An exemplary tracer insert body comprises a separator between the upper and lower cavities and may comprise a flow channel that extends from the top of the insert body, through the upper cavity and separator to the lower cavity. The flow channel may provide a flow of air through the tracer insert that will aid in the release of the tracer powder compound when fired. The flow channel may be relatively small, such as no more than about 0.5 mm in cross-length dimension, or diameter to prevent release of tracer powder compound when loading the tracer insert with the tracer compound.

An exemplary tracer insert may be configured for insertion into a shotgun shell of various sizes including, but not limited to, 12 gauge, 16 gauge, 20 gauge, 28 gauge and any gauge between and including the gauge values provided. An exemplary tracer insert may have suitable dimensions for insertion into these shotgun gauge shells and may have a length that is about 10 mm or greater, about 20 mm or greater, about 30 mm or greater, about 40 mm or greater, about 60 mm or greater and any range between and including the lengths provided. Likewise, an exemplary tracer insert may have a width or diameter that is about 3 mm or greater, about 5 mm or greater, about 10 mm or greater, about 20 mm or greater, about 50 mm or greater and any range between and including the lengths provided. The tracer insert may be elongated, having a length that is about twice the width or diameter, or greater.

The upper cavity of the tracer insert has a width that is larger than the shot diameter to enable shot to be retained in the upper cavity upon firing, to aid in the projection of the tracer insert. In an exemplary embodiment, the upper cavity is tapered, or the width of the cavity is tapered in dimension, from the top to the bottom of the upper cavity. A tapered upper cavity will allow shot of varying sizes to be retained in the upper cavity upon firing. In an exemplary embodiment, the upper cavity is ring-shaped, having a deflector centrally located to deflect shot down into the ring-shaped cavity. The deflector may be cone-shaped to create a tapering cavity for retaining shot of different sizes. Put another way, the deflector may taper in dimension from the bottom of the upper cavity to the top of the deflector. The flow channel may extend through the deflector and the separator between the upper and lower cavities.

An exemplary lower cavity of the tracer insert is below the upper cavity and has a volume for retaining a tracer powder compound. The lower cavity may be cylindrically-shaped and may have an open bottom to allow the release of the tracer powder compound upon firing. A closure may be configured on the bottom of the lower cavity to contain the tracer powder compound therein and the bottom exhaust port may be configured in the closure. A closure may be a cap that extends over the bottom of the lower cavity and the cap may be a separate piece that is attached to the insert body after filling of the lower cavity with tracer powder compound. In another embodiment, a portion of the tracer insert body may be crimped or folded over the bottom of the lower cavity to create a closure for the tracer powder compound. The folded or crimped portion of the tracer insert body may form a bottom exhaust port for the release of the tracer powder compound upon firing.

The bottom exhaust port is configured to allow the release of the tracer powder compound upon firing. The bottom exhaust port may have a width or diameter that is large enough to allow the tracer compound to be effectively released, and may be about the dimension of the inner wall of the lower cavity or smaller than the dimension of the inner wall of the lower cavity such as about 2 mm or greater, about 4 mm or greater, about 10 mm or greater, about 20 mm or greater and any range between and including the sizes provided.

A tracer insert may comprise one or more side exhaust ports that extend through the outer wall of the tracer insert body into the lower cavity. An exemplary side exhaust port may extend to the bottom of the insert body. In an exemplary embodiment, a tracer insert comprises a plurality of side exhaust ports that extend down to the bottom of the insert body which enables folding or crimping of the bottom of the insert body to form a closure. An exemplary side exhaust port may be elongated, having a length that is at least three times greater than a width. The length of the side exhaust port may extend along a length axis, or the length of the tracer insert body. In another embodiment, the side exhaust port may have a length that spirals or extends at an offset angle to the length of the tracer insert body. The length of a side exhaust port may be about 4 mm or greater, about 6 mm or greater, about 10 mm or greater, about 20 mm or greater, about 40 mm or greater and any range between and including the lengths provided. The width of a side exhaust port may be about 1 mm or greater, about 2 mm or greater, about 4 mm or greater, about 8 mm or greater, about 20 mm or greater and any range between and including the widths provided.

A tracer powder compound comprises tracer powder, that may be colored or contain a dye or pigment. The tracer powder compound may further comprise a binder to harden or solidify the tracer powder for retention in the lower cavity. In an exemplary embodiment, the tracer powder compound comprises calcium carbonate powder that is colored or contains a dye or pigment and a binder. A binder or hardener, may be any suitable plaster compound including, but not limited to, plaster of paris containing calcium sulfate hemihydrate, lime and sand or cement, gypsum and the like. A tracer powder compound may be formed by combining the tracer powder with the binder along with a mixing liquid, such as water, solvent or alcohol. In an exemplary embodiment, three parts of a tracer powder is mixed with one part binder and mixing liquid to form a paste that can be inserted into the lower cavity. The paste then dries to form a solid tracer powder compound that when agitated, such as by air movement thereover, turns into powder and is released. The tracer powder compound may be any suitable color including, but not limited to, black, yellow, red, orange, blue, green and the like. It has been found that orange may be an effective color on sunny days and a darker color, such as black or blue may be more effective on cloudy days, wherein the darker color is seen more clearly with the white cloud background.

An exemplary tracer shell comprises a tracer insert, as described herein located within a shotgun shell. An exemplary tracer insert may be inserted into the hull portion of a shell or within a shot-pocket of a wad. The tracer insert may be inserted with the upper cavity facing upward or toward the top of the hull portion or wad. Shot may be place in an around the tracer insert and the shell may be closed. As described herein, the shot will be retained in the upper cavity and upon firing the shot retained in the upper cavity will aid in propelling the tracer insert from the gun. As the wad, with shot and tracer insert are fired from the gun, the agitation of firing along with the flow of air over and in some cases through the tracer insert, releases the tracer powder compound to produce a tracer trail that is visible to the shooter. A tracer trail may extend 30 meters to allow a shooter to clearly see the direction of the shot and determine the offset from a moving target. The tracer insert body may be projected a distance from the gun and may be retrieved later for disposal. In an exemplary embodiment, the tracer insert body is not projected more than 200 yards, or the distance allowed at many outdoor firing ranges.

The tracer insert, as described herein, enables a user to load their own tracer shells. A user simply has to place the tracer insert into the shell, pour in the shot around the tracer insert and then close the shell.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
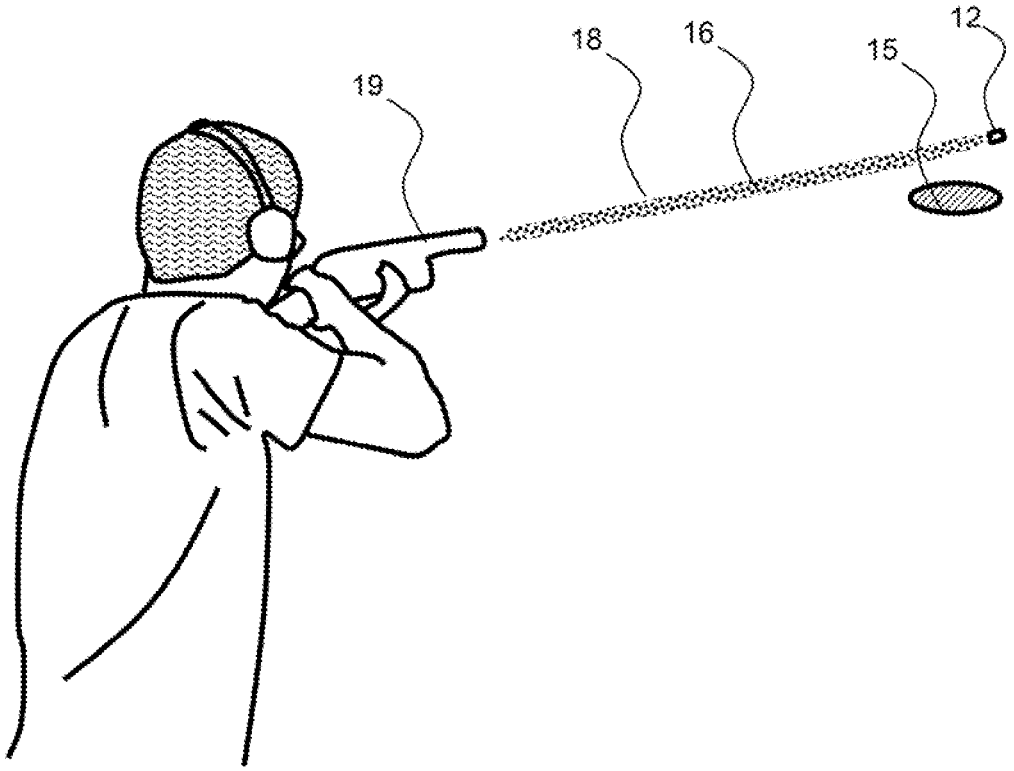
FIG. 1 shows a target shooter firing a shell having an exemplary tracer insert.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, as some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a target shooter is firing a tracer shell from a gun 19 at a clay skeet target 15. The tracer powder 16 from the tracer insert 12 is being released to produce a tracer trail 18. The shooter has fired above the target and the tracer trail will help the shooter make the appropriate corrections and become a more accurate shooter.

Figure 2:
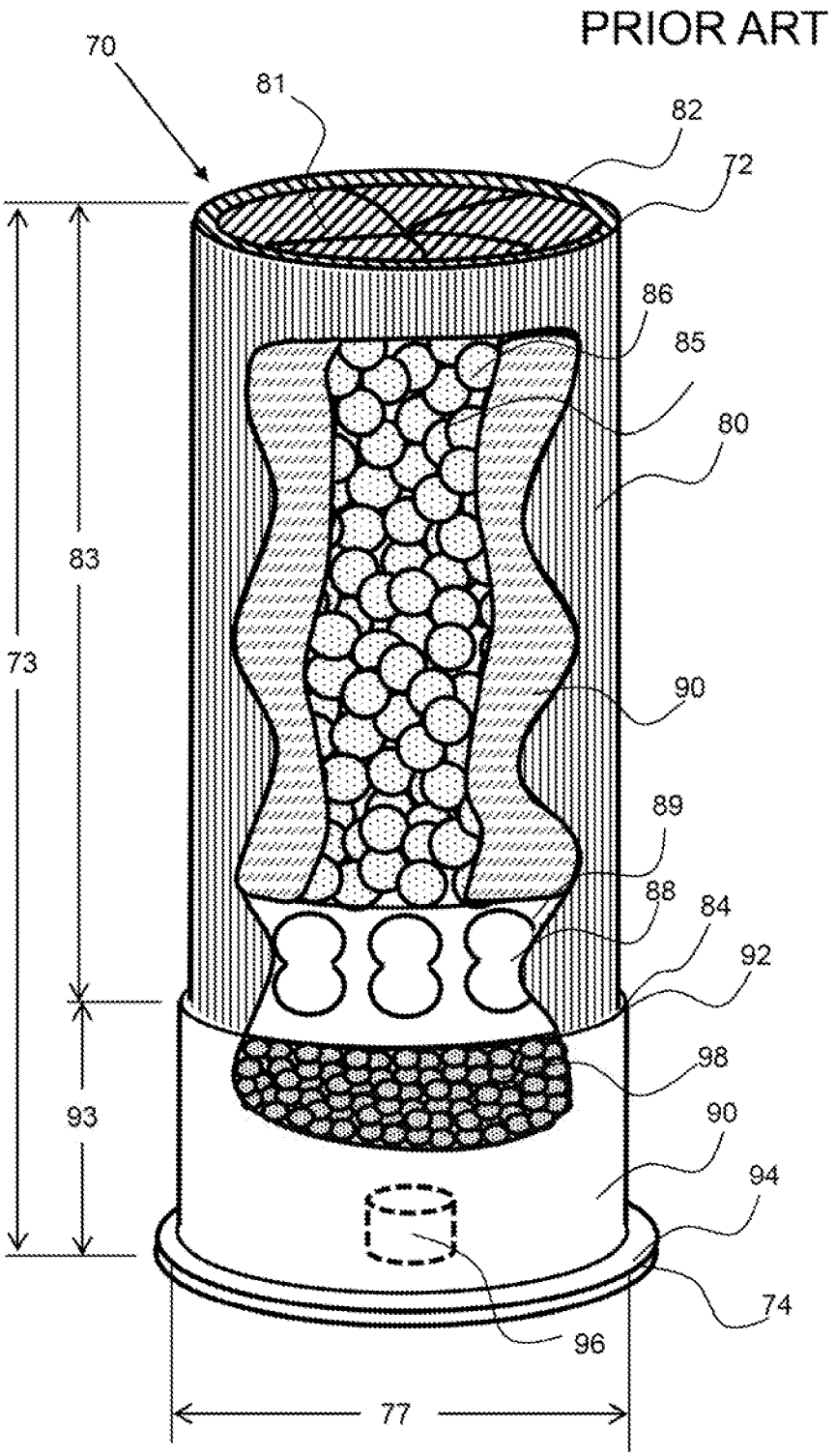
FIG. 2 shows a perspective view of a shotgun shell.

As shown in FIG. 2, a standard shotgun shell 70 has a length 73 from the top 72 to the bottom 74 of the shell. The shell has a hull 80 and a head 90. The head is typically made of metal and contains the powder charge 98 that ignites to propel the wad 89 and shot 86. The head has a length 93 from the top of the head 92 to the bottom of the head 94. A primer 96 is configured in the bottom of the head to initiate ignition of the powder charge. The hull has a length 83 from the top of the hull portion 82 to the bottom of the hull portion 84. The wad 89, configured within the hull portion of the shell has a wad head 88 and a shot-pocket 90 for receiving and retaining shot. The shot 86 is contained within the shot-pocket of the wad. The hull has a crimp 81 over the top of the hull portion that opens upon firing to release the shot. The diameter 77 of the shell is shown.

Figure 3:
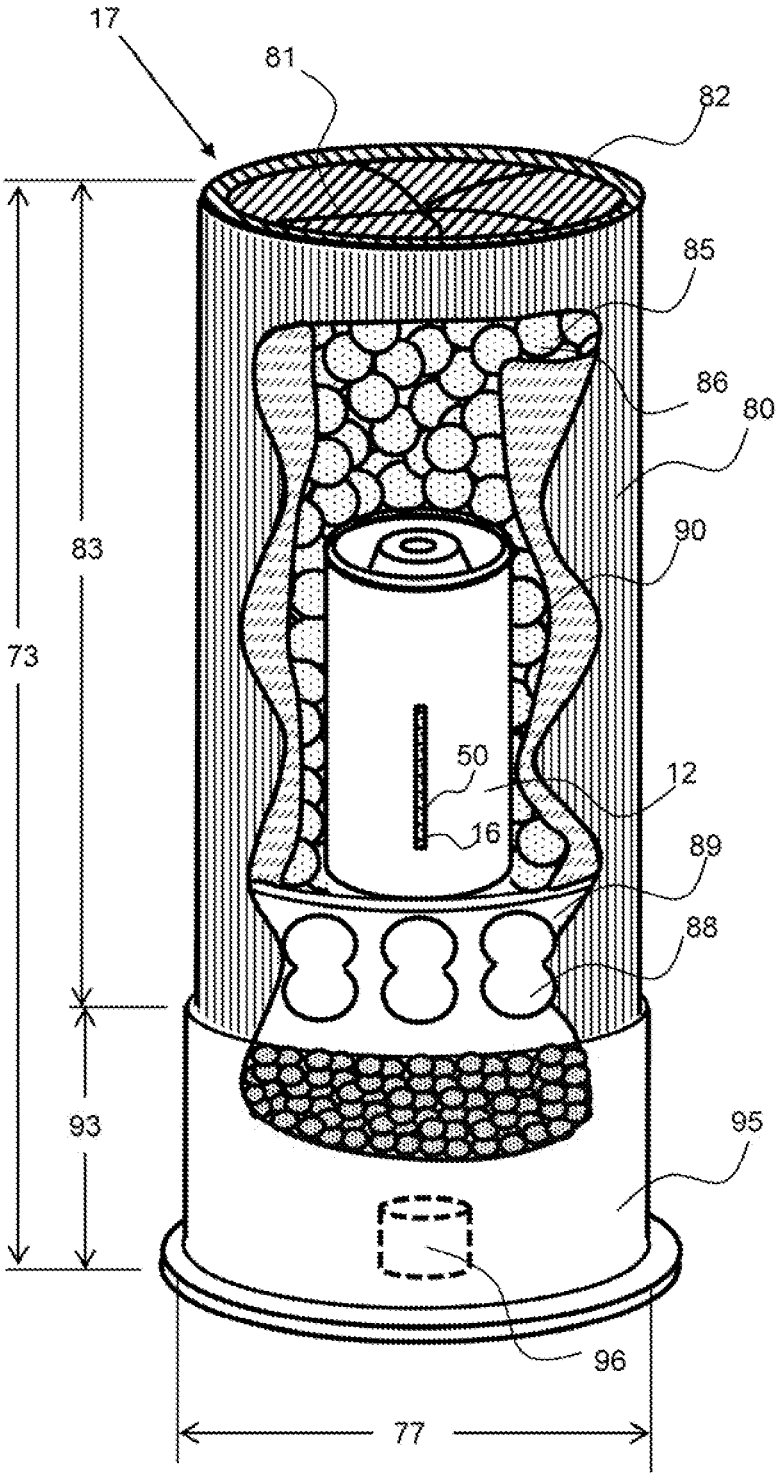
FIG. 3 shows a perspective view of an exemplary tracer shell having a tracer insert configured therein.

As shown in FIG. 3, an exemplary tracer shell 17 has a tracer insert 12 configured therein. The tracer insert is configured within the shot-pocket 90 of the wad 89, and when the tracer shell is fired, some of the shot 86 will enter into the upper cavity of the tracer insert to help propel the tracer insert. Tracer powder compound 16 is configured within a lower cavity and in an exemplary embodiment is released from side exhaust ports and from a bottom exhaust port.

Figure 4:
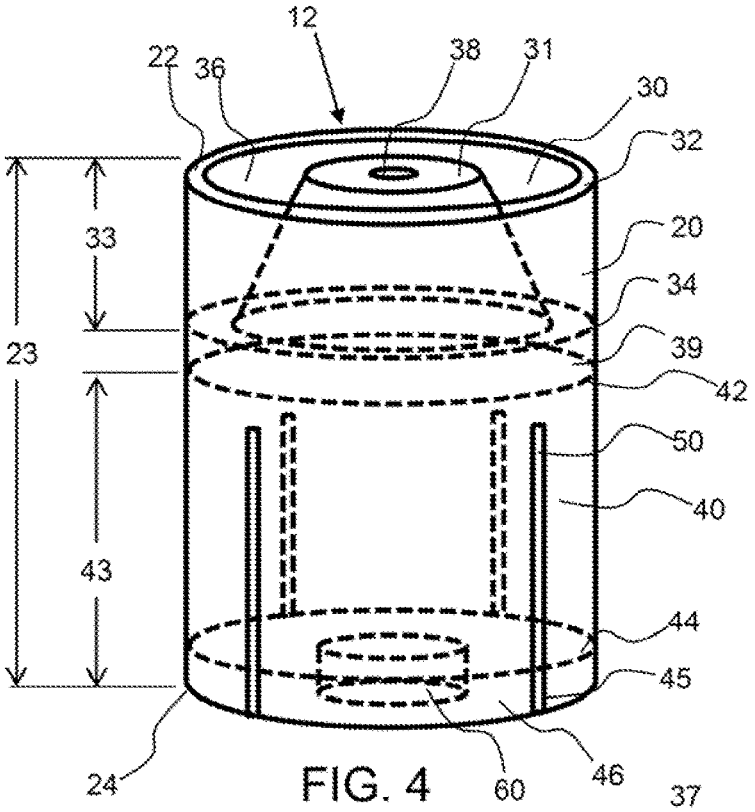
FIG. 4 shows a perspective view of an exemplary tracer insert having an upper cavity for receiving shot and a lower cavity containing tracer powder.
Figure 5:
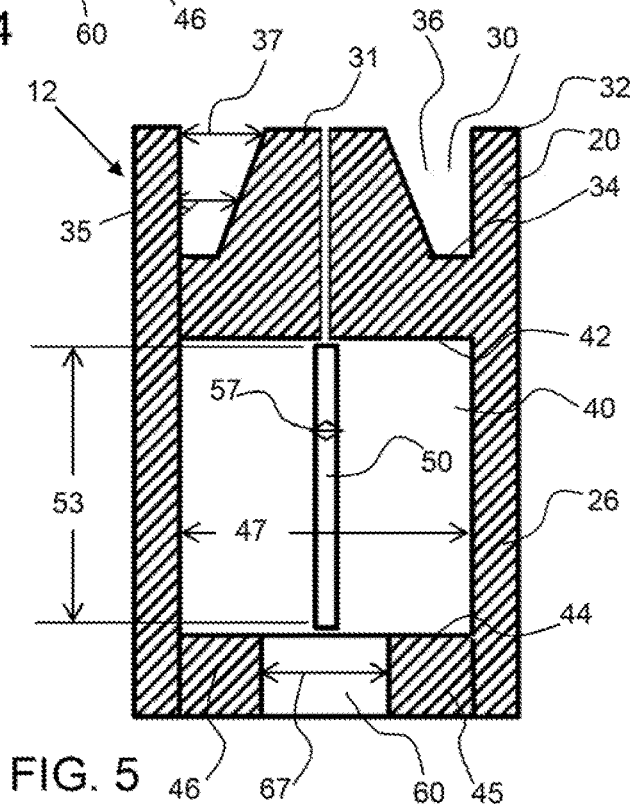
FIG. 5 shows a cross-sectional view of an exemplary tracer insert.

Referring now to FIGS. 4 and 5, an exemplary tracer insert 12 has an insert body 20 having an upper cavity 30 for receiving shot upon firing and a lower cavity 40 containing tracer powder compound. The upper cavity has an opening 36 that has an opening width 37 that is larger than the shot diameter. An upper cavity deflector 31 is configured to deflect shot into the upper cavity opening where it propels the tracer insert upon firing. The upper cavity has a tapering width from the upper cavity opening to the bottom 34 of the upper cavity. This truncating width of the upper cavity allows shot to be trapped within the upper cavity upon firing, as the shot is lodged and trapped dimensionally in the upper cavity. The upper cavity is ring-shaped with the deflector having a cone shape centrally located within the upper portion of the tracer insert or upper cavity. The upper cavity has a length from the top 32 of the upper cavity to the bottom 34 of the upper cavity or the top of the separator 39, that separates the upper and lower cavities. A flow channel 38 extends from the top of the tracer insert body down through the upper cavity and through the cavity separator 39 to the lower cavity 40. The flow channel provides a flow of air to aid in the release of the tracer powder compound.

The lower cavity has a length 43 from the top 42 of the upper cavity to the bottom 44 of the lower cavity, or to the top surface of the cap 45. Tracer powder is retained within the lower cavity and is expelled from the lower cavity upon firing. In an exemplary embodiment, a bottom exhaust port 60 is configured in the closure 45 and is centrally located within the closure. The closure shown in a cap 46. The width or diameter 67 of the bottom exhaust port may be selected for a desired rate of tracer powder exhaust. Optionally, a tracer insert may have one or more side exhaust ports 50, that are in the outer wall 26 of the tracer insert and allow tracer powder to be expelled therethrough upon firing. The side exhaust ports 50 has a length 53 and a width 57. Side exhaust ports may be configured around the perimeter of the lower cavity such as being located every 90 degrees around the perimeter of the tracer insert. A tracer insert body may comprise one, two, three or more, or four or more side exhaust ports. The side exhaust ports may extend down to the bottom of the lower cavity. The diameter of the lower cavity 47 is shown.

Figure 6:
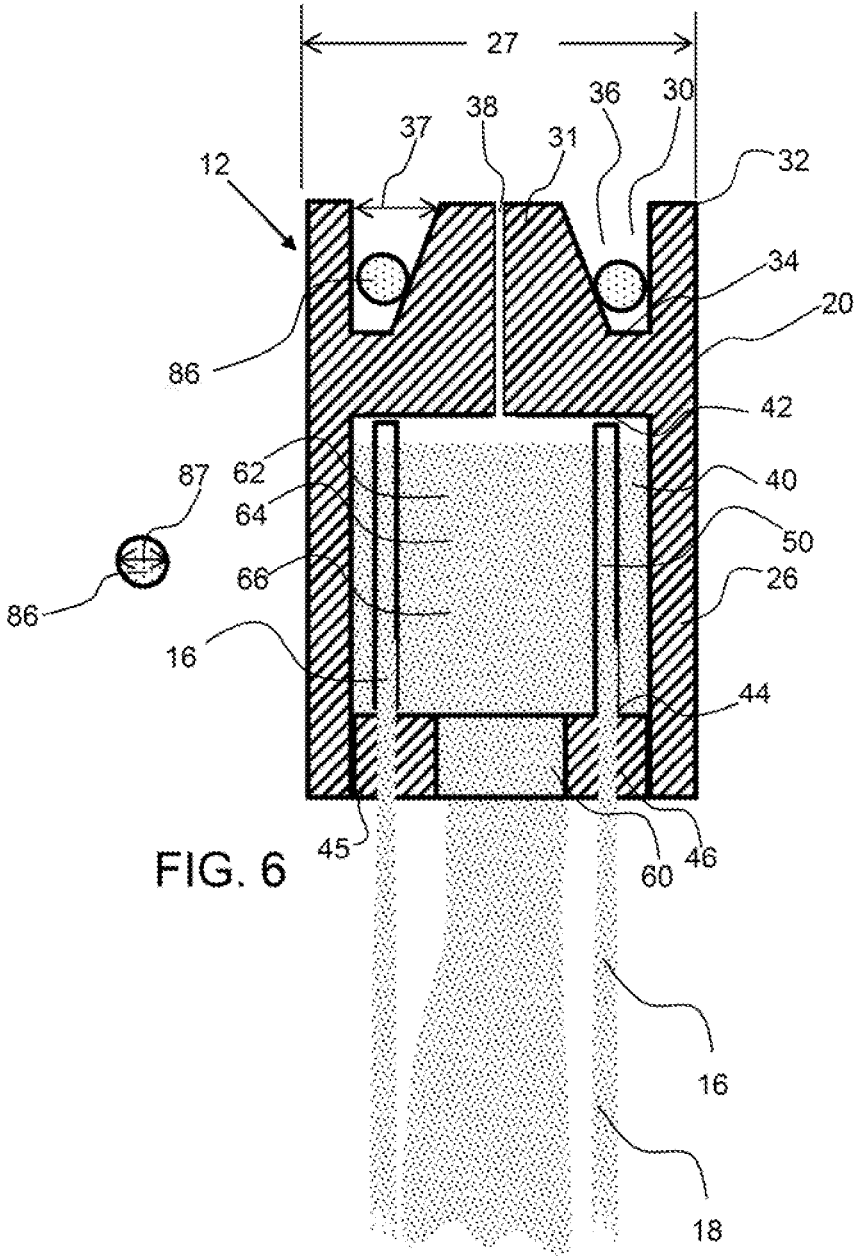
FIG. 6 shows a cross-sectional view of an exemplary tracer insert that has been fired and tracer powder trailing from the tracer insert from the bottom exhaust port as well as from two side exhaust ports.

As shown in FIG. 6, an exemplary tracer insert 12 has been fired and tracer powder 16 is trailing from the tracer insert from the bottom exhaust port 60 as well as from two side exhaust ports 50. Air flows through the flow channel 38 to aid in the release of tracer powder compound. The tracer powder flows through the bottom exhaust port in the closure 45 and through the side exhaust ports 50 in the outer wall 26 of the tracer insert body 20. The closure is a cap 46 that is attached to the tracer insert body. Shot 86 having a shot diameter 87 is wedged and trapped within the upper cavity 30. The shot was forced into the upper cavity through the upper cavity opening 36. The diameter 27 of the tracer insert 12 is shown.

Figure 7:
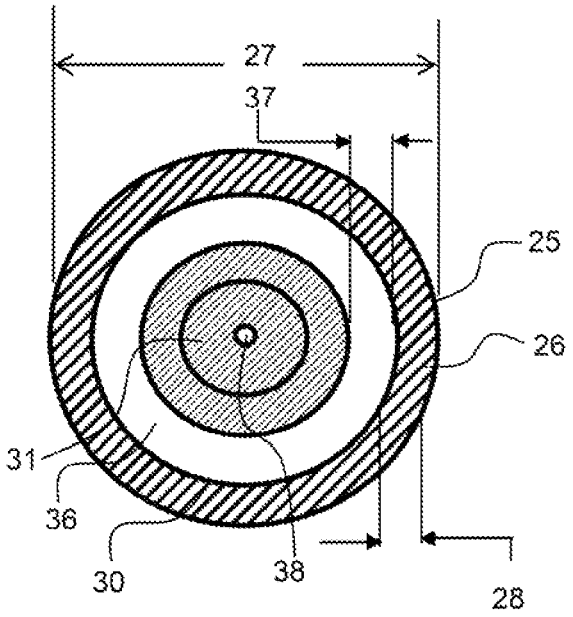
FIG. 7 shows a top view of an exemplary tracer insert having a upper cavity for receiving shot.

As shown in FIG. 7, an exemplary tracer insert has an upper cavity 30 for receiving shot. The upper cavity opening width 37 is larger than the shot diameter. The deflector 31 deflects shot into the upper cavity opening 36. The tracer insert has a diameter 27 and an outer wall 26 having a wall thickness 28. The wall thickness is from the outer surface 25 to the upper cavity 30. An exemplary flow channel 38 is centrally located in the deflector 31 to aid in the release of tracer powder compound.

Example 1

The lower cavity of an exemplary tracer insert, as described herein, was loaded with a tracer insert compound. The compound was made by mixing three parts of calcium carbonate, having an orange color, with one part plaster of paris and isopropyl alcohol to form a paste. The paste was inserted into the lower cavity and dried to form a solid tracer powder compound within the lower cavity. The insert was then placed into the shot-pocket of a wad in a 12-gauge shotgun shell. Approximately 7/8 ounces of number 8 shot was poured in and around the tracer insert and some of the shot was retained in the upper cavity of the tracer insert. The hull was closed to produce a tracer shell. The tracer shell was fired from a shotgun at a firing range and the tracer trail extended approximately 30 meters from the shotgun.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention, provided they come within the scope of the appended claims and their equivalents.

What is claimed is:

1. A tracer insert comprising:

a) an insert body comprising:

i) a length from a top to a bottom;

ii) a length axis extending from the top to the bottom of the tracer insert body;

iii) an upper cavity extending down from the top of the insert body and comprising an upper cavity opening in the top of the insert body;

iv) a deflector centrally located within the upper cavity;

wherein the upper cavity is ring-shaped and extends around said centrally located deflector;

v) a lower cavity located below to the upper cavity of the insert body;

vi) a bottom exhaust port in the bottom of the insert body;

b) tracer powder compound within the lower cavity;

c) a side exhaust port that extends through an outer wall of the tracer insert body into the lower cavity to allow the tracer powder compound to be expelled through the side exhaust port upon firing the tracer insert;

wherein the tracer powder is released through the bottom exhaust port upon firing of the tracer insert from a gun;

whereby the tracer powder is configured for release from the tracer insert through the bottom exhaust port and the side exhaust port.

2. The tracer insert of claim 1, wherein the tracer insert is cylindrically-shaped having a cylindrical outer wall and an outer diameter.

3. The tracer insert of claim 1, wherein the upper cavity is ring-shaped and extends around a centrally located deflector.

4. The tracer insert of claim 3, wherein the upper cavity has a width that tapers from an upper cavity opening width to a bottom of the upper cavity.

5. The tracer insert of claim 4, wherein the deflector is cone-shaped.

6. The tracer insert of claim 1, wherein a separator extends between the upper cavity and the lower cavity.

7. The tracer insert of claim 1, further comprising a side exhaust port that extends through an outer wall of the tracer insert body into the lower cavity to allow the tracer powder compound to be expelled through the side exhaust port upon firing the tracer insert.

8. The tracer insert of claim 7, comprising a plurality of side exhaust ports.

9. The tracer insert of claim 7, wherein the side exhaust port is elongated, having a length that is at least three times greater than a width.

10. The tracer insert of claim 1, further comprising a closure located on the bottom of the tracer insert body that comprises said bottom exhaust port.

11. A tracer shell comprising:

a) a shell having length from a top to bottom and comprising:

b) a hull portion located at the top of the shell and forming a cavity for receiving a wad;

c) said wad comprising a wad head and a shot-pocket for receiving shot;

wherein the shot has a shot diameter, d) a head located at the bottom of the shell and comprising:

i) a cavity containing a powder charge; and ii) a primer;

e) a tracer insert located in the shot pocket between the head and the top of the shell and comprising:

i) an insert body comprising:

a length from a top to a bottom;

a diameter;

an upper cavity extending to the top of the insert body and comprising:

an upper cavity opening in the top of the insert body having an upper cavity opening width that is larger than said shot diameter and wherein shot is retained within the upper cavity;

a lower cavity located proximal to the bottom of the insert body;

a bottom exhaust port in the bottom of the insert body;

ii) tracer powder compound within the lower cavity;

f) a side exhaust port that extends through an outer wall of the tracer insert body into the lower cavity to allow the tracer powder compound to be expelled through the side exhaust port upon firing the tracer insert:

wherein the tracer powder is released through the bottom exhaust port upon firing of the tracer shell from a gun.

12. The tracer shell of claim 11, wherein the tracer insert is configured within the shot-pocket of the wad and within the hull portion of the tracer shell.

13. The tracer shell of claim 11, wherein the tracer insert body is cylindrically-shaped having a cylindrical outer wall.

14. The tracer shell of claim 11, wherein the upper cavity is ring-shaped and extends around a centrally located deflector.

15. The tracer shell of claim 14, wherein the upper cavity has width that tapers from an upper cavity opening width to a bottom of the upper cavity.

16. The tracer shell of claim 15, wherein the deflector is cone-shaped.

17. The tracer shell of claim 11, wherein a separator extends between the upper cavity and the lower cavity of the tracer insert body.

18. The tracer shell of claim 11, further comprising a side exhaust port that extends through an outer wall of the tracer insert body into the lower cavity to allow the tracer powder to be released through the side exhaust port upon firing the tracer shell.

19. The tracer shell of claim 18, wherein the side exhaust port is elongated, having a length that is at least three times greater than a width.

20. The tracer shell of claim 11, wherein the tracer insert comprises a closure located on the bottom of the tracer insert body that comprises said bottom exhaust port.

* * * * *